US012349785B2

(12) United States Patent
Toofer

(10) Patent No.: US 12,349,785 B2
(45) **Date of Patent: *Jul. 8, 2025**

(54) FINGER-WEARABLE ORAL HYGIENE DEVICE AND METHOD OF USING

(71) Applicant: Mindful People LLC, Los Angeles, CA (US)

(72) Inventor: Michael Toofer, Los Angeles, CA (US)

(73) Assignee: Mindful People LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/136,806

(22) Filed: Apr. 19, 2023

(65) Prior Publication Data

US 2023/0404250 A1 Dec. 21, 2023

Related U.S. Application Data

(63) Continuation of application No. 17/460,039, filed on Aug. 27, 2021, now Pat. No. 11,659,921, which is a (Continued)

(51) Int. Cl.
*A46B 5/04* (2006.01)

(52) U.S. Cl.
CPC ..... *A46B 5/04* (2013.01); *A46B 2200/1026* (2013.01); *A46B 2200/1066* (2013.01)

(58) Field of Classification Search
CPC ..... A46B 5/04; A47L 13/18; B08B 1/002
(Continued)

(56) References Cited

U.S. PATENT DOCUMENTS 1,611,510 A 12/1926 Brown
1,946,283 A 2/1934 Hoffman et al.
(Continued)

FOREIGN PATENT DOCUMENTS

BE 1009218 A6 1/1997
BE 1010017 A3 11/1997
(Continued)

OTHER PUBLICATIONS

Barkley 360° Fingerbrush [on-line]. [Review posted Oct. 2, 2020 on homepage for Jasper 360° Finger Toothbrush.] [Internet retrieval date: Jan. 23, 2024.] URL: <URL: https://www.amazon.com/Jasper-Toothbrush-Ergonomic-Surround-Bristles/dp/B098PF4NPQ?ref_=ast_slp_dp&th=1>Shopping_NC_Dog_HC_Health%20%26%20Wellness&utm_term=45854445307 40036&utm_content=Toothbrushes-Dog>(Year: 2021).
(Continued)

*Primary Examiner* — Randall E Chin
(74) *Attorney, Agent, or Firm* — Mueting Raasch Group

(57) ABSTRACT

Disclosed are finger-wearable oral hygiene devices having a tapered shape with a plurality of extensions extending from the outer surface of the body, with the plurality of extensions extending around at least most of the circumference of the body member, the extensions being longer near the distal end of the device and shorter near the proximal end of the device, or the extensions arranged in a staggered pattern along the length of the tubular body, or having combination of these features. The device allows gums and teeth to be massaged or cleaned more efficiently and thoroughly, and can also provide greater comfort to a subject during an oral hygiene process.

20 Claims, 10 Drawing Sheets

Related U.S. Application Data continuation of application No. 16/568,018, filed on Sep. 11, 2019, now Pat. No. 11,103,053.

(60) Provisional application No. 62/765,736, filed on Sep. 11, 2018.

(58) Field of Classification Search
USPC ..... D4/103; D30/158
See application file for complete search history.

(56) References Cited

U.S. PATENT DOCUMENTS

| | | | |
|---|---|---|---|
| 1,965,009 | A | 7/1934 | Stevens |
| 2,075,681 | A | 3/1937 | Welker |
| 2,103,083 | A | 12/1937 | Lynch |
| 2,112,184 | A | 3/1938 | Vogan |
| 3,043,295 | A | 7/1962 | Ward |
| 3,623,481 | A | 11/1971 | Curran |
| 3,984,148 | A | 10/1976 | Regester |
| 4,665,901 | A | 5/1987 | Spector |
| D313,317 | S | 1/1991 | Brunner et al. |
| 5,068,941 | A | 12/1991 | Dunn |
| 5,213,428 | A | 5/1993 | Salman |
| D350,851 | S | 9/1994 | Spence, Jr. |
| D360,300 | S | 7/1995 | Castillo |
| D362,118 | S | 9/1995 | Nelson |
| D363,606 | S | 10/1995 | Abrahamson |
| 5,636,405 | A | 6/1997 | Stone |
| D383,307 | S | 9/1997 | Klein et al. |
| 5,765,252 | A | 6/1998 | Carr |
| 5,826,599 | A | 10/1998 | Adams |
| 5,909,739 | A | 6/1999 | Masrour-Rad |
| D422,121 | S | 3/2000 | Peck |
| 6,336,461 | B1 | 1/2002 | Martinez |
| 6,584,637 | B1 | 7/2003 | Witter |
| D485,072 | S | 1/2004 | Brown-Paschal |
| D537,165 | S | 2/2007 | Leite et al. |
| D542,540 | S | 5/2007 | Hollaren et al. |
| D595,508 | S | 7/2009 | Wagner |
| D605,407 | S | 12/2009 | Wagner |
| 8,522,391 | B1 | 9/2013 | Safieh |
| D738,626 | S | 9/2015 | Wagner |
| D748,397 | S | 2/2016 | Wagner |
| 9,320,348 | B2 | 4/2016 | Sabet |
| 9,743,751 | B1 | 8/2017 | Luis et al. |
| D827,306 | S | 9/2018 | Sabet et al. |
| D848,748 | S | 5/2019 | Sabet et al. |
| 11,103,053 | B2 | 8/2021 | Toofer |
| D932,032 | S | 9/2021 | Ayala et al. |
| 11,659,921 | B2 | 5/2023 | Toofer |
| D997,467 | S | 8/2023 | Liu |
| 2005/0268369 | A1 | 12/2005 | Santiago |
| 2006/0040062 | A1 | 2/2006 | Witter |
| 2006/0137069 | A1 | 6/2006 | Yang et al. |
| 2009/0035048 | A1 | 2/2009 | Safieh |
| 2011/0061189 | A1 | 3/2011 | Meadows et al. |
| 2014/0223682 | A1 | 8/2014 | Sabet |
| 2014/0261538 | A1 | 9/2014 | Elseri |
| 2016/0015161 | A1 | 1/2016 | Mullen |
| 2018/0250105 | A1 | 9/2018 | Sabet et al. |
| 2020/0253351 | A1* | 8/2020 | Frazier ..... A45D 7/00 |

FOREIGN PATENT DOCUMENTS

| | | | |
|---|---|---|---|
| CA | 2 891 089 | A1 | 9/2016 |
| CN | 2 105 868 | | 9/1972 |
| CN | 2143069 | Y | 10/1993 |
| CN | 2202525 | Y | 7/1995 |
| CN | 2246430 | | 2/1997 |
| CN | 101543433 | A | 9/2009 |
| CN | 201870024 | U | 6/2011 |
| CN | 201968058 | U | 9/2011 |
| CN | 202112553 | U | 1/2012 |
| CN | 202566871 | U | 12/2012 |
| CN | 103598722 | A | 2/2014 |
| CN | 305252735 | | 7/2019 |
| CN | 306765349 | | 8/2021 |
| CN | 307261211 | | 4/2022 |
| DE | 34 29 655 | A1 | 2/1986 |
| DE | 196 07 078 | A1 | 7/1997 |
| DE | 100 05 381 | A1 | 9/2001 |
| DE | 20 2012 012 311 | U1 | 4/2013 |
| EP | 0 252 710 | A1 | 1/1988 |
| GB | 324237 | | 1/1930 |
| GB | 398919 | | 9/1933 |
| GB | 1053955 | | 1/1967 |
| GB | 2352975 | A | 2/2001 |
| IN | 202648 | | 3/2007 |
| JP | 2000-024064 | A | 1/2000 |
| JP | 3842918 | B2 | 8/2006 |
| JP | 2016-000184 | A | 1/2016 |
| JP | 2017-213220 | A | 12/2017 |
| KR | 10-2005-0073735 | A | 7/2005 |
| KR | 10-0525471 | B1 | 11/2005 |
| KR | 10-2012-0084347 | A | 7/2012 |
| KR | 10-2018-0020727 | A | 2/2018 |
| WO | 95/31154 | A1 | 11/1995 |
| WO | 97/33498 | A1 | 9/1997 |
| WO | 2013/009138 | A2 | 1/2013 |

OTHER PUBLICATIONS

Jasper Finger Dog & Cat Toothbrush [on-line]. [Publication date of oldest review: Oct. 28, 2021.] [Internet retrieval date: Jan. 23, 2024.]V https://www.chewy.com/jasper-finger-dog-cat-toothbrush/dp/359486?utm_id=401602605&mscl kid=84f1227706311ed9171147c77e91fe65&utm_source=bing&utm_medium=cpc&utm_campaign= (Year: 2021).

Jasper Dog Toothbrush . . . [on-line]. [Earliest review date: Jan. 18, 2021.] [Internet retrieval date: Jan. 23, 2024.] URL: <https://www.amazon.com/Jasper-Toothbrush-Ergonomic-Surround-Bristles/dp/B098PF4NPQ>(Year: 2021).

* cited by examiner

FINGER-WEARABLE ORAL HYGIENE DEVICE AND METHOD OF USING

CROSS-REFERENCE TO RELATED APPLICATION

This application is a continuation of U.S. application Ser. No. 17/460,039, filed Aug. 27, 2021, now U.S. Pat. No. 11,659,921, which is a continuation of U.S. application Ser. No. 16/568,018, filed Sep. 11, 2019, now U.S. Pat. No. 11,103,053, which claims the benefit of commonly owned Provisional U.S. Application Ser. No. 62/765,736, filed Sep. 11, 2018 entitled "360 Degree finger toothbrush," which are incorporated herein by reference in their entireties.

FIELD OF INVENTION

The invention is directed to oral hygiene devices configured to be placed on the end of a finger.

BACKGROUND

Proper oral hygiene is important for maintaining the health of oral cavity tissues, including teeth and gums. In many cases, the subject in need of oral hygiene is an infant, a young child, or even a pet, and therefore it is necessary that a caregiver provide oral hygiene to the oral cavity of the subject.

Some oral hygiene devices are in the form of a glove or a thimble-like device having surface features that are used to clean teeth or massage gums. However, existing designs are less than ideal and can make it difficult for the user to efficiently and properly clean teeth and stimulate gums. Further some designs can be irritating to areas in or near the oral cavity, such as a subject's lips.

SUMMARY

The invention provides finger-wearable oral hygiene devices having, in the least, unique and innovative surface features that facilitate better oral hygiene, such as improved methods for cleaning and/or stimulating oral tissues, such as teeth and/or gums and also non-natural items (e.g., dentures).

In embodiments, the invention provides a finger-wearable oral hygiene device that has body member with a tapered shape and an open proximal end, a closed distal end, a length between the ends, and a circumference. The proximal end is sized to allow for insertion of a finger, which the device is configured to fit over. The device has a wall that defines a body member of the device, and the wall provides outer and inner surfaces.

A plurality of extensions extend from the outer surface of the wall of the body member. The device also has one or more of the following features (a) to (c): (a) a plurality of extensions extending around at least most of the circumference of the body member, (b) extensions that are longer near the distal end of the device and shorter near the proximal end of the device; (c) extensions that are arranged in a staggered pattern along the length of the body member.

In some embodiments the device includes all three features (a), (b), and (c).

In embodiments, the finger-wearable oral hygiene device is designed to cover the distal phalange of a finger, at least a portion of the medial phalange, and optionally a portion of the proximal phalange.

In embodiments, the device can be described with regards to proximal section, a central section, a distal section, and a central axis, wherein the width of the body member in the proximal section is greater than the width of the body member in the distal section, and the width of the device as measured from extension tips on opposite sides of the device in the proximal section is less than the width of the device as measured from opposite extension tips in the distal section.

In embodiments, the extensions increase in height in a proximal to distal direction, and the increase in height of the extensions in the central section is greater than the increase in height of the extensions in the proximal section.

In embodiments, in the proximal section, tips of the extensions define a line that is angled towards the central axis in a distal direction, and in the central section, tips of the extensions define a line that is angled away from the central axis in a distal direction.

In embodiments, the proximal section extends 30-40% of the length of the device, the central section extends 40-54% of the length of the device, and the distal section extends 15-25% of the length of the device.

In embodiments, the extensions have a base attached to the wall of the body member and a distal end representing the tip of the extension, and the cross-sectional area of the base is greater than the cross-sectional area of the tip.

In embodiments, the body member has an outer surface area, the plurality of extensions have a total cross sectional area of their bases, and the total cross sectional area of the extension bases is at least 40% of the outer surface area of the body member.

The device can also be described with regards to the pattern of extensions on the body member. In embodiments, the device has an extension pattern defined by a plurality of columns of extensions, each column following a linear path that extends in a proximal to distal direction parallel to the central axis, wherein the column runs a portion of the length of the device.

In embodiments, the device has an extension pattern wherein the extensions are arranged in a staggered pattern along the length of the tubular body and forms a line of extensions that follows at least part of an elliptical path on the surface of the body member.

The invention also provides methods for providing oral hygiene to a subject, In embodiments, the method includes steps of introducing the device of the disclosure into the oral cavity of a subject and contacting gums or teeth of the subject with at least a portion of the extensions, preferably the longer extensions in the distal section that have a bristle-like appearance. In some embodiments, the step of contacting gums or teeth of the subject includes contacting with a first portion of the device having extensions, and then with a second portion of the device having extensions, wherein the first portion and second portion are on opposite sides of the device.

The invention also provides kits for providing oral hygiene to a subject. The kit can include device of the disclosure and an oral treatment composition, such as toothpaste or composition that includes a medicament to soothe gums.

DETAILED DESCRIPTION

The embodiments of the present invention described herein are not intended to be exhaustive or to limit the invention to the precise forms disclosed in the following detailed description. Rather, the embodiments are chosen and described so that others skilled in the art can appreciate and understand the principles and practices of the present invention.

The disclosure provides embodiments of finger-wearable oral hygiene devices that have a plurality of extensions that extend from the outer surface of a wall of a body member of the device. In embodiments, (a) the extensions extend around at least most of the circumference of the body member, (b) the extensions are longer near the distal end and shorter near the proximal end of the device, (c) the extensions are arranged in a staggered pattern along the length of the body member, such as that they follow at least part of an elliptical path on the body member surface, or any combination of (a)-(c).

Figure 7:
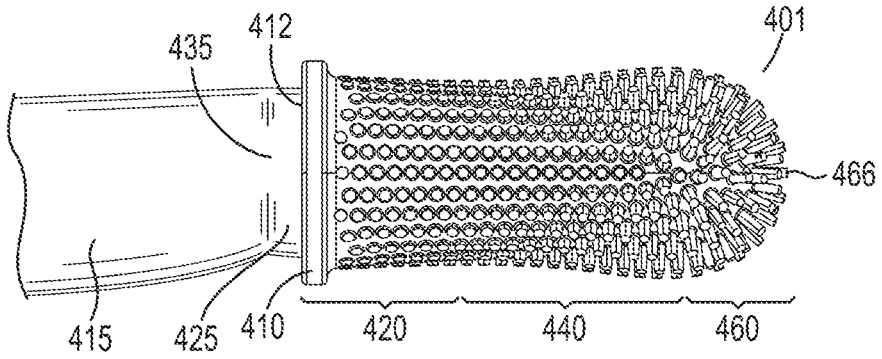
FIG. 7 is an illustration of an embodiment of finger-wearable oral hygiene device with the distal section of a user's finger inserted into the device.

In embodiments, the finger-wearable oral hygiene device is designed to cover the distal phalange of a finger, at least a portion of the medial phalange, and optionally a portion of the proximal phalange. For example, FIG. 7 shows the device 401 over the distal phalange (not shown) and most of the medial phalange 425 of a finger 415. The distal end 412 of the device is positioned just distal to the proximal interphalangeal joint 435 whether the device can accommodate at least a portion of the medial phalange, all of the medial phalange, or a portion of the proximal phalange can depend on the overall length of the device from the proximal to distal ends, which can vary.

Embodiments of the invention include finger-wearable oral hygiene devices as illustrated in FIGS. 1-12. With reference to FIGS. 1, 2, 6, and 7, portions of finger-wearable oral hygiene device (1, 101, 401) are described with reference to proximal (20, 120, 320, 420), central (40, 140, 340, 440), and distal (60, 160, 360, 460) sections of the device. Reference to the arrangement of features of the finger-wearable oral hygiene device can also be described with reference to the proximal end (12, 112, 312, 412) and distal end (66, 166, 366, 466) of the device.

Figure 3:
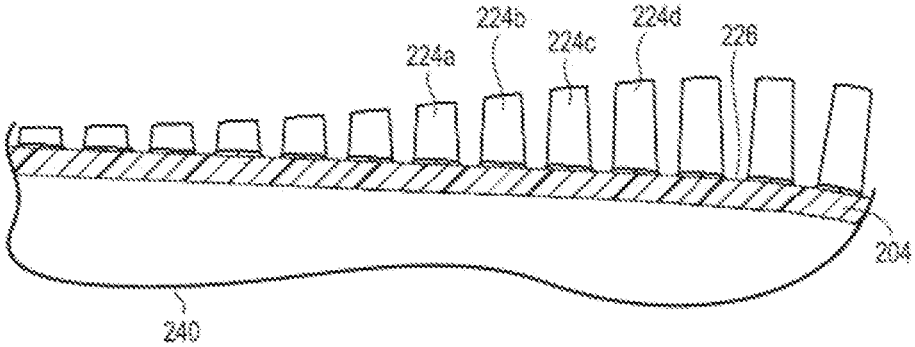
FIG. 3 is a side cross-sectional view of the central section of an embodiment of a finger-wearable oral hygiene device showing the wall of the body member and extensions extending from the outer surface of the wall.
Figure 4:
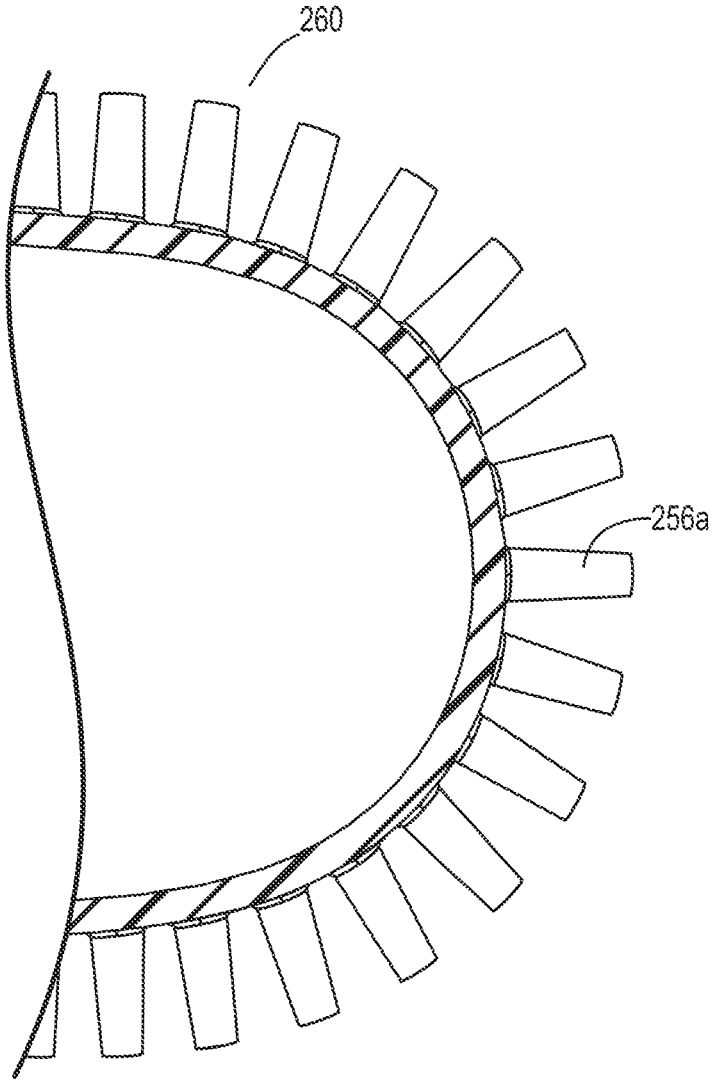
FIG. 4 is a side cross-sectional view of the distal end an embodiment of a finger-wearable oral hygiene device showing the wall of the body and extensions extending from the outer surface of the wall.
Figure 5:
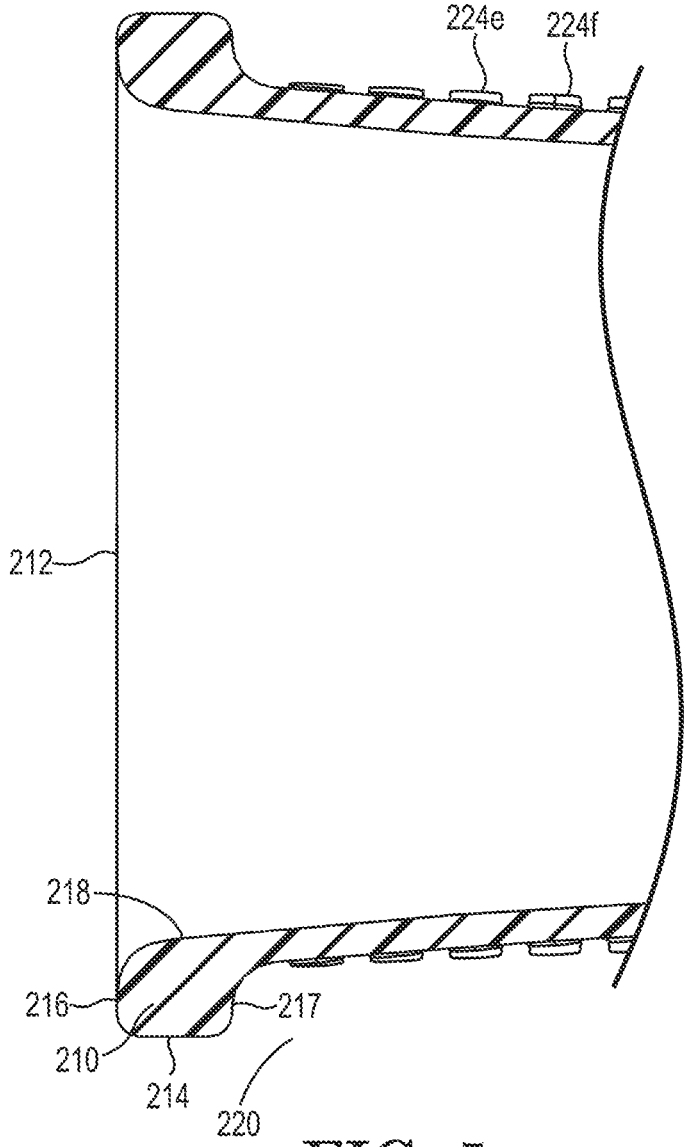
FIG. 5 is a side cross-sectional view of the proximal end an embodiment of a finger-wearable oral hygiene device showing the wall of the body and extensions extending from the outer surface of the wall.

These portions are also shown in greater detail in FIGS. 3-5, with FIG. 3 showing the central section 240, FIG. 4 showing the distal section 260, and FIG. 5 showing the proximal section 220.

Figure 2:
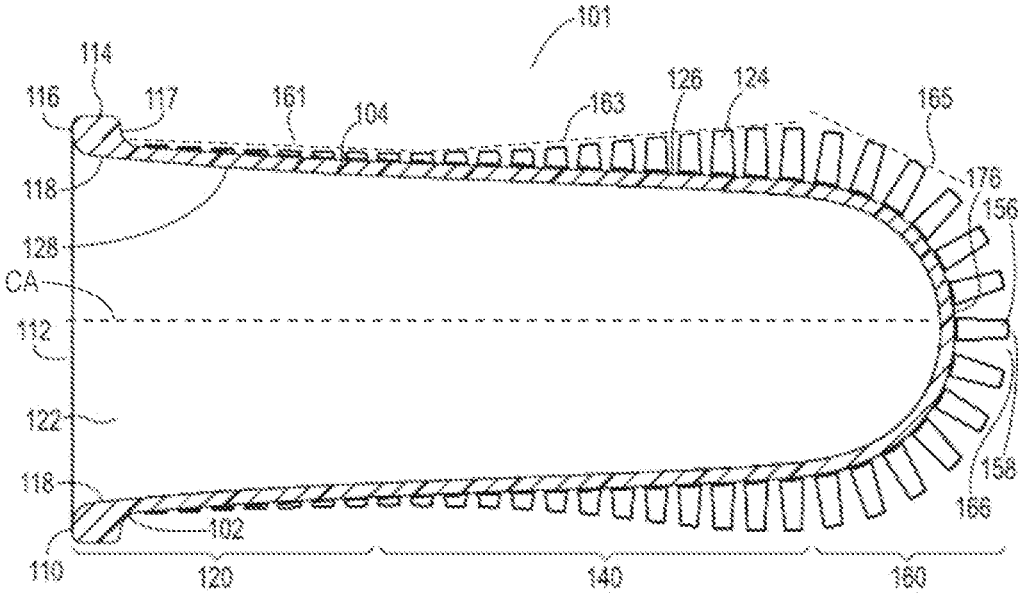
FIG. 2 is a side cross-sectional view of an embodiment of a finger-wearable oral hygiene device showing the wall of the body member and extensions extending from the outer surface of the wall.

Referring to FIG. 2, the finger-wearable oral hygiene device 101 is defined by a body member 102 that provides the device with a tapered shape, and has an opening 122 at the proximal end 112, and a closed distal end 166. The closed distal end 166 generally has a curved or rounded shape. The body member 102 has a central opening or cavity 122 sized and shaped to accommodate a portion of a finger of a user. Also, the device 101 and portions thereof can be defined by a central axis (CA) extending from the center of the proximal end 112 to the center of the distal end 166.

The body member 102 has a wall 104 which is generally formed from a flexible material, such as an elastomer (i.e., a synthetic or natural polymer having elastic properties, such as rubber). The wall 104 has a thickness, which can be the same over the entire body member, or can change. The wall 104 of the body member 102 can provide an inner surface 128 and an outer surface 126. The inner surface can be in contact with the finger of a user. A plurality of extensions 124 extend from the outer surface 126 of the wall of the body member.

As noted herein, the body member 102 can have a tapered shape, with the wall 104 of the body member angling towards the central axis (CA) in a proximal to distal direction in at least the proximal 120 and central 140 sections of the device. In embodiments, the angle of the wall 104 relative to the central axis (CA) is in the range of about 2° to about 5°, and preferably in the range of about 3° to about 4°. In the distal section 160, the wall 104 curves in toward the central axis (CA) and meets at the center point to form the closed end.

Dimensions of the device can be chosen based on factors such users finger size and desired coverage of a certain length of the finger. The device can be constructed to accommodate the fingers of users having different hand/finger sizes (small, medium, large, etc.).

The overall length of the device can be described as being from the proximal end 112 of the device to the distal tip 158 of the most distal extension 156 extending from the distal end of the body member. Generally, the overall length will be at least about 40 mm, such as in the range of about 40 mm about 60 mm, or preferably in the range of about 45 mm to about 55 mm.

A length from the proximal end 112 of the device to the distal end 176 of the body member can also be described. Generally, this length will be at least about 37 mm, in the range of about 37 mm about 57 mm, or preferably in the range of about 42 mm to about 52 mm. In embodiments, the overall length of the device (112→158) is about 5-12.5% longer that the length of the proximal end of the device to the distal end of the body member (112→176).

The device has body member width that varies from the proximal to distal end. In exemplary constructions, the width of the body member (i.e., as measured from the wall on one side of the body member to the wall on the other side of the body member) at the proximal end 122 will be at least about 18 mm, in the range of about 18 cm about 28 mm, or preferably in the range of about 21 mm to about 25 mm. Generally, the width near the distal end 166, such as the junction of the central section 140 and the distal section 160, will be at least about 10 mm, in the range of about 10 mm about 20 mm, or preferably in the range of about 13 mm to about 17 mm.

The width of the device can also be described with reference to the width across the device (i.e., perpendicular to the central axis (CA)) from the tips of extensions on opposite sides of the device. The width across the device measured from opposite extension tips in the central 140 and/or distal 160 section(s), can be greater than the width in the proximal section 120. This is despite the width of the body member in the proximal section 120 being greater than the width of the body member in either the central 140 and/or distal sections 160. In some embodiments, the width in the central and/or distal section is about 5% to about 10% greater than the width in the proximal section as measured from extension tips on opposite sides of the device. Accordingly, the increased lengths of the extensions in the central and distal sections of the device provide for this unique profile, and facilitate improved oral hygienic methods.

With reference to FIGS. 1, 2, 5, and 7, the device can also have a rim (10, 110, 210, 410, 510) at the proximal end (12, 112, 212, 412), which is the proximal most portion of the wall of the body member. With reference to FIG. 5, the rim (110, 210) can extend outwards (away from the center of the device) and have distal-facing surface (117, 217), outer facing surface (114, 214), proximal facing surface (116, 216), and inner facing surface (118, 218). The rim (110, 210) can have a curved transition between inner facing surface (118, 218) and proximal facing surface (116, 216), proximal facing surface (116, 216) and outer facing surface (114, 214), and outer facing surface (114, 214) and distal-facing surface (117, 217). In some embodiments, the distance between proximal facing surface (116, 216) and distal-facing surface (117, 217) is greater than the distance between outer facing surface (114, 214) and inner facing surface (118, 218).

Referring back to FIGS. 2 and 3, the thickness of the wall (104, 204) of the body member is generally in the range of about 0.60 mm to about 0.90 mm, and more preferably in the range of about 0.70 mm to about 0.76 mm, such as about 0.73 mm. The thickness of the wall can in part be based on the type of material that is used to construct the device. For example, if the wall is made of a very flexible elastomeric material, such as silicone rubber, then thicker walls can be possible as the device can still be bent or manipulated by a user. However, if a more rigid elastomeric material is used, such as a polyurethane, then it might be desirable to have the wall be relatively thin as such materials will not be as bendable.

Examples of different types of elastomeric materials that can be used to make the device include, but are not limited to, silicone rubber (SiR), polyfluorosilicone (FSi), polyurethane (PU), styrene butadiene polymers (SBR), saturated nitrile polymers (HNBR), nitrile butadiene polymers (NBR), fluoropolymers (e.g., Viton elastomer), chloroprene polymers (e.g., Neoprene), butyl rubber, polyisoprene, and combinations thereof.

As described herein, a plurality of extensions extends from the outer surface of the wall of the body member of the device. The extension are longer (i.e., have a greater height) near the distal end 166 of the device and are shorter near the proximal end 112 of the device. The extensions also extend around at least most of the circumference of the body member, such as more than 50% of the circumference, more than 60%, more than 70%, more than 80%, more than 90%, more than 95% of the circumference, and preferably fully around the circumference of the body member.

Further, the extensions can be arranged in a staggered pattern along the length of the tubular body, and the staggered pattern can provide an extension pathway that is skew to the central axis (CA), wherein the pathway can follow part or all of an elliptical pathway around the device.

The device, and aspects of the extensions on the body member, can optionally be described with regards to aspects of the proximal (20, 120, 420), central (40, 140, 440), and distal (60, 160, 460) sections of the device.

For example, as shown in FIG. 2, the device can have a proximal section 120 that extends a less than half the length of the device, such as about 30-40% or more, and preferably about 33-37% of the length of the device. In the proximal section 120 the extensions are on average shorter than the extensions of the central 140 or distal 160 sections. Also, as shown in FIG. 2, line 161 corresponds to the plane of the tips of the extensions of the proximal section 120 and this line 161 is angled towards the central axis moving in the distal direction. In this regard, both line 161 and the wall of the body member in proximal section 120 are angled towards the central axis (CA) in a distal direction.

Also shown in FIG. 2, central section 140 can extend from less than half the length of the device to more than half the length of the device, such as about 40-54% or more preferably, about 44-50% of the length of the device. The extensions of the central section 140 are on average longer than the extensions of the proximal section 120, but shorter than the extensions of the distal section 160. Also, as shown in FIG. 2, line 163 corresponds to the plane of tops of the extensions of the central section 140 and this line 163 is angled away the central axis CA in the distal direction. In this regard, line 163 and the wall of the central section 140 are at divergent angles with regards to the central axis.

Also shown in FIG. 2, distal section 160 extends less than a third of the length of the device, such as about 15-25% or more preferably about 18-22% of the length of the device. The extensions of the distal section 160 are on average longer than the extensions of the proximal 120 and central 140 sections. Also, as shown in FIG. 2, line 165 corresponds to the plane of the tops of the extensions of the distal section 160 and is angled towards the central axis in the distal direction. In this regard, both line 165 and the wall of the body member in proximal section 120 are angled towards the central axis (CA) moving in the distal direction.

Figure 1:
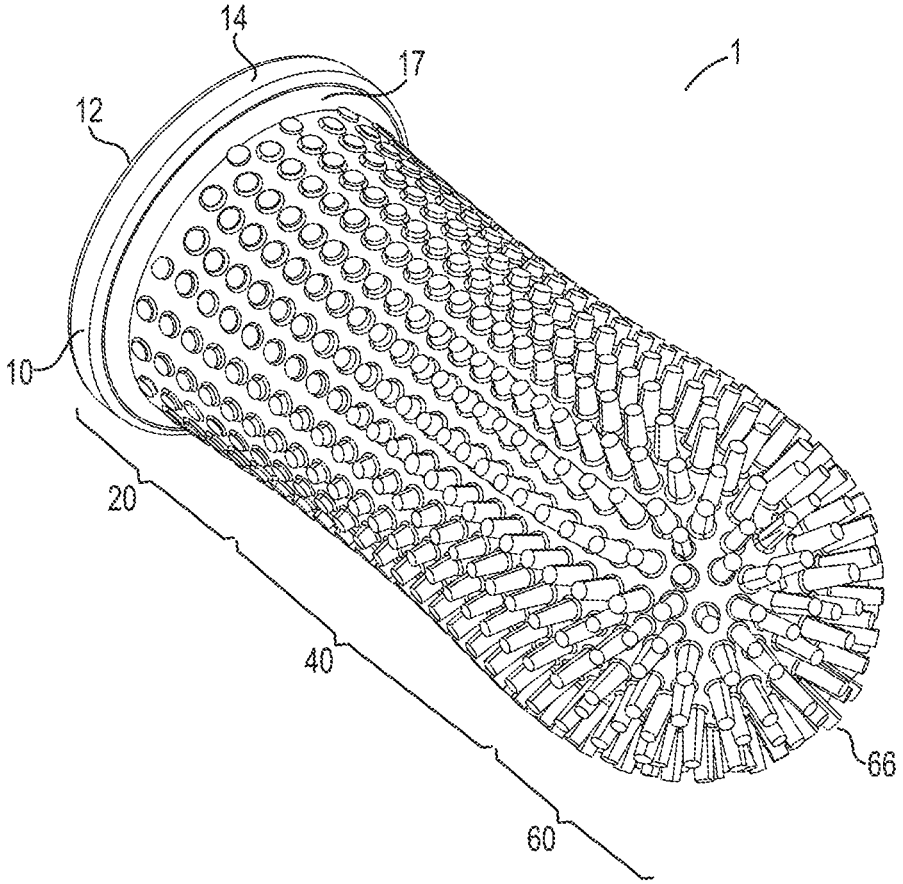
FIG. 1 is a perspective view of an embodiment of a finger-wearable oral hygiene device.
Figure 8:
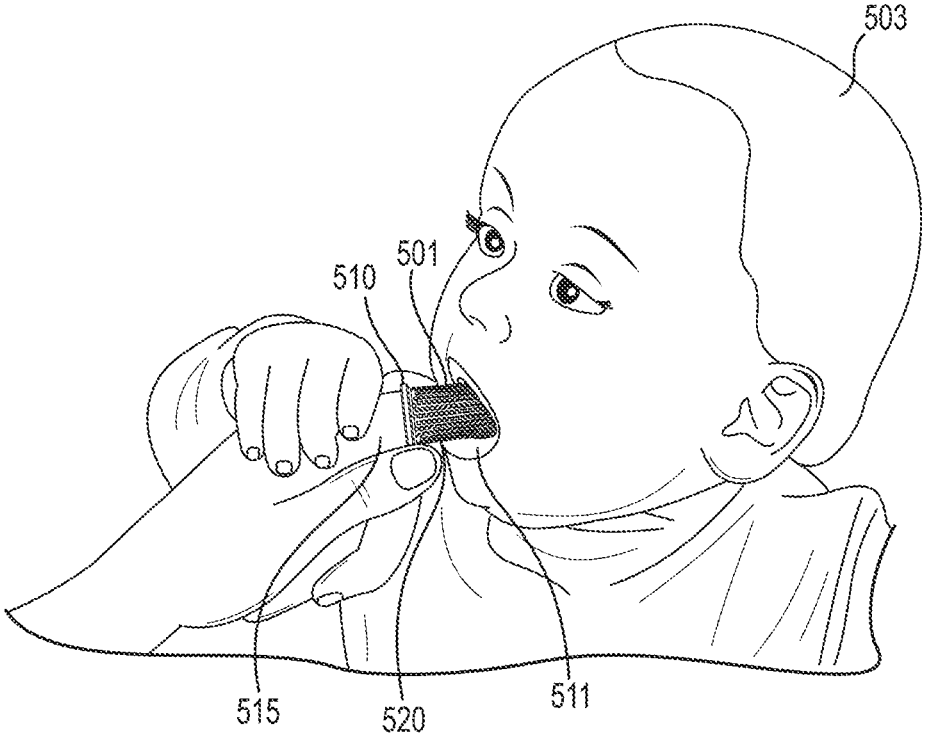
FIG. 8 is an illustration of an embodiment of finger-wearable oral hygiene device with the distal section of a user's finger inserted into the device, and the distal section of the device inserted into the oral cavity of a subject.
Figure 9:
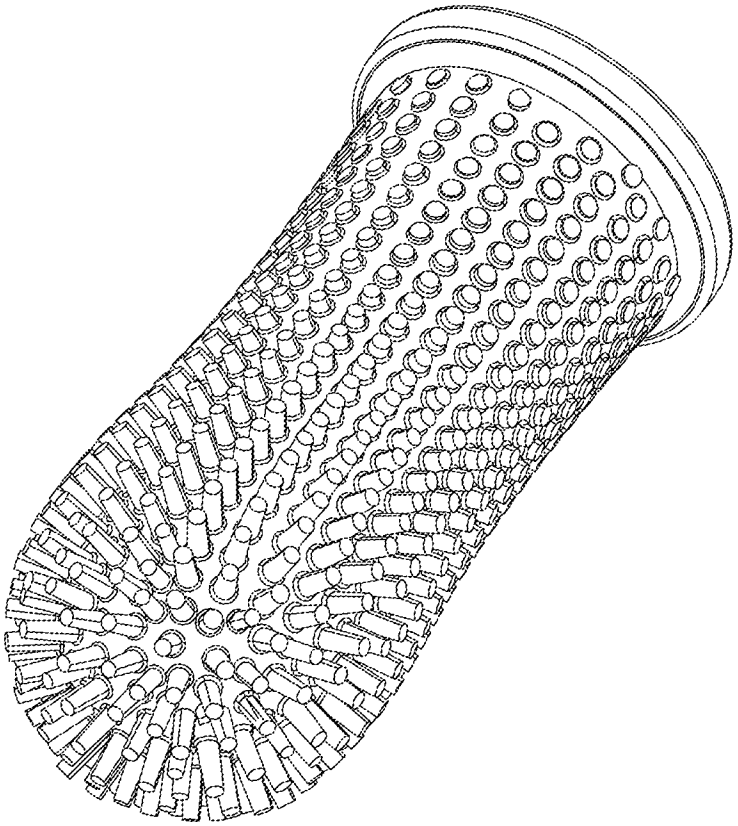
FIG. 9 is a perspective view as seen from the distal end of an embodiment of a finger-wearable oral hygiene device.
Figure 10:
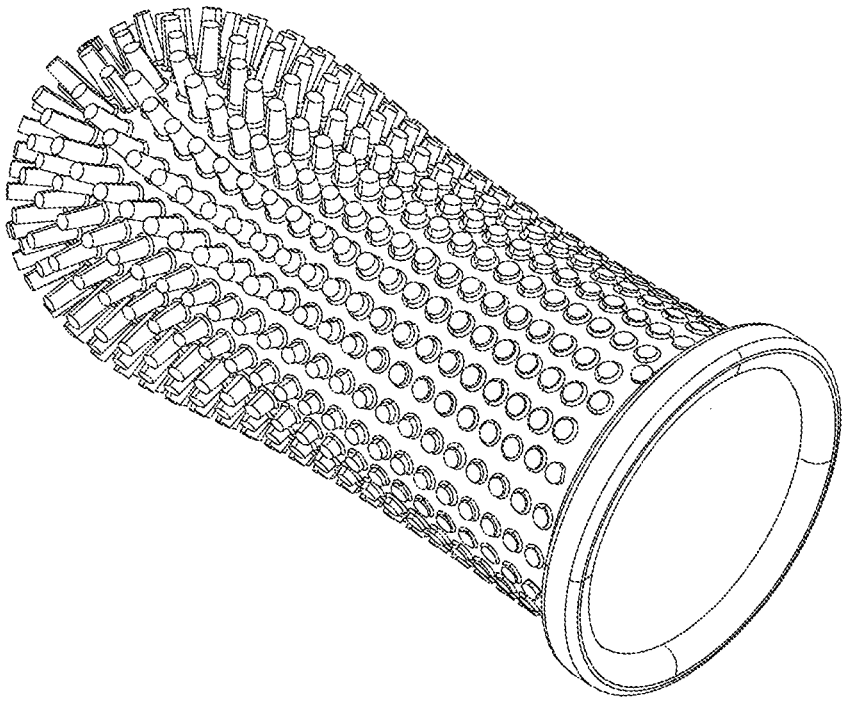
FIG. 10 is a perspective view as seen from the proximal end of an embodiment of a finger-wearable oral hygiene device.
Figure 11:
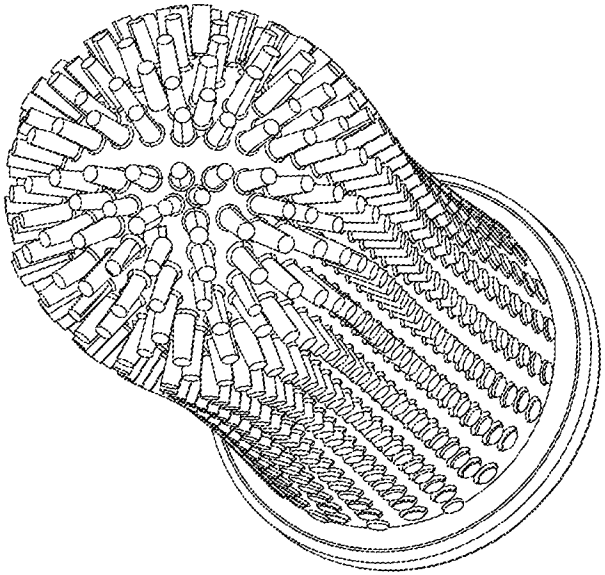
FIG. 11 is another perspective view as seen from the distal end of an embodiment of a finger-wearable oral hygiene device.
Figure 12:
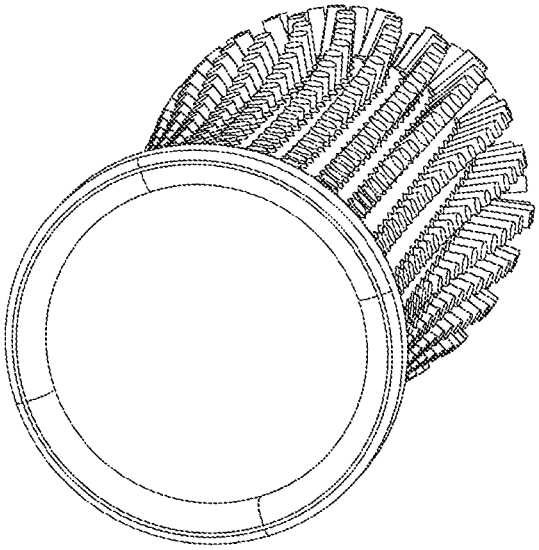
FIG. 12 is another perspective view as seen from the proximal end of an embodiment of a finger-wearable oral hygiene device.

With reference to FIGS. 1, 2, and 8, the device includes a plurality of extensions (e.g., 124, 224 etc.) that extend outwards from the outer surface (126, 226) of the wall (104, 204) of the body member. In embodiments, some or most of the extensions have a tapered shape, having widths at their bases (the base being attached to the outer surface of the wall) that are greater than the widths at their tips.

As shown in FIG. 1, the extensions have a circular shape at their bases and tips. However, the extensions may be of other shapes, such as polygonal (e.g., triangular, square, rectangular, pentagonal, hexagonal, etc.) as desired.

The surface of the device can also be covered with a desired number of extensions. As a general matter, the device has an extension profile and pattern that allows a generally high density of extensions to be present on the surface of the device. In turn, the high density can facilitate improved oral hygiene by allowing the user to contact the teeth and/or gums of a subject with a large number of extensions when the device is used. In embodiments, the device has about 400 or greater, or about 500 or greater extensions extending from the outer surface of the wall of the body member, such as a number of extensions in the range of about 450 to about 800, about 500 to about 750, about 550 to about 700, about 575 to about 675, or about 600 to about 650.

The density of the extensions can also be described with reference to the outer surface of the body member, and the percent area that the extensions occupy on the outer surface. To determine this, for example, the area of the outer surface (without extensions) can be determined. In embodiments, the area of the outer surface is in the range of about 2000 $mm^2$ to about 2700 $mm^2$, or about 2200 $mm^2$ to about 2500 $mm^2$, with a specific exemplary outer surface area being about 2350 $mm^2$. The cross-sectional area of the base of an extension and the number of extensions can be determined to calculate the total cross-sectional area (base) of the plurality of extensions. In embodiments, the cross sectional area of a base of the extension is at least about 1.00 $mm^2$, at least about 1.10 $mm^2$, such as in the range of about 1.70 to about 1.85 $mm^2$, or about 1.75 to about 1.80 $mm^2$. In embodiments, the cross-sectional area of a tip of the extension is in the range of about 0.60 $mm^2$ to about 0.8 $mm^2$, or about 0.68 $mm^2$ to about $mm^2$.

Accordingly, in embodiments, the area of the extensions is in the range of about 930 $mm^2$ to about 1260 $mm^2$, or about 1025 $mm^2$ to about 1165 $mm^2$, with a specific exemplary area being about 1095 $mm^2$. In embodiments, the plurality of extensions occupy a surface area on the body member of at least 40%, such as an amount in the range of about 40% to about 55%, about 42% to about 50%, or about 44% to about 49%.

As can be seen from FIGS. 1, 2, and 7, extensions (e.g., 124, 224) that extend from the outer surface (126, 226) of the wall (104, 204) of the body member generally become greater in length from the proximal end 112 to the distal end 166 of the device. Accordingly, the extensions on the surface of the body member will be of varying lengths. In exemplary embodiments, these lengths can be in the range of about 0.1 mm to about 3.5 mm, about 0.125 mm to about 3.25 mm, or about 0.15 mm to about 3.0 mm.

Near the proximal end 112 the shorter extensions have a "stub-like" appearance, with the heights of the extensions being less than their widths. For example, see FIG. 5, which shows in greater detail a part of the proximal section 220 with a series of stub-like extensions (e.g., 224*b*). Moving in a distal direction along the wall 104, the extensions increase in length, and in the central section 140 of the device some of the extensions have a profile wherein their heights are greater than their widths. For example, see FIG. 3, which shows in greater detail a part of the central section 240 with a series of stub-like extensions, wherein extension 224*a*, and the extensions distal to this extension, have a profile wherein their heights are greater than their widths.

Generally, consecutive extensions increase in length along the wall of the body member from the proximal to distal direction. For example, referring to FIG. 3, the length of extension 224*b* is greater than the length of extension 224*a*, the length of extension 224*c* is greater than the length of extension 224*b*, the length of extension 224*d* is greater than the length of extension 224*c*, etc. The length of the extensions can increase as noted to a maximum extension length in the distal section of the device.

The increase in the length of the extensions can be described with regards to the relative increase in length of extensions in sections of the device. In some embodiments, in the central section (140, 240), consecutive extensions increase in length in a greater amount than the increase in length of consecutive extensions in the proximal section (120, 220), the increases measured for consecutive extensions along the wall of the body member in a proximal to distal direction. The increases in lengths can be measured relative to the longest extension of the device (i.e., in the distal section).

For example, in the proximal section (120, 220), consecutive extensions in a proximal to distal direction increase can in length by less than 4%, such as in the range of about 1% to less than 4%, in the range of about 1% to about 3.5%, or about 1% to about 3%, relative to the longest extension of the device. For example, with reference to FIG. 5, if extension 224*e* is 0.25 mm, and extension 224*f* is 0.3125 mm, and with reference to FIG. 4 the extension having the greatest length (256*a*) is 2.95 mm, then the percentage increase from 224*e* to 224*f* relative to 256*a* is 2.12%.

In the central section (140, 240), the increase in length of the consecutive extensions is greater than in the proximal section (120, 220). For example, in the central section (140, 240), consecutive extensions in a proximal to distal direction can increase in length by 4% or greater, such as in the range of 4% to about 15%, in the range of 4% to about 12.5%, or about 4% to about 10%, relative to the longest extension of the device. For example, with reference to FIG. 3, if extension 224*a* is 2.2 mm, and extension 224*b* is 2.49 mm, and with reference to FIG. 4 the extension having the greatest length (256*a*) is 2.95 mm, then the percentage increase from 224*a* to 224*b* relative to 256*a* is 9.8%.

In embodiments, in the distal section (160, 260), most or all of the extensions can have the same length. For example, if there is any variation in the lengths of the extensions in the length, the variation in length can be minimal, such as about 5% or less, about 4% or less, about 3% or less, or about 2% or less.

The extensions (and plurality thereof) can also be described with regards to an extension profile, as described by a ratio of the height of the extension to the width of the extension (as measured at the base of the extension). In embodiments, the plurality of extensions of the device have a profile ratio in the range of about 1:40 to about 3.25 to 1, about 1:30 to about 3:1, or about 1:20 to about 2.75:1.

In embodiments, an amount of extensions in the range of about 30% to about 70%, about 35% to about 65%, about 40% to about 60%, or about 45% to about 55% of the total extensions have a profile ratio of greater than about 1:1.

In embodiments, an amount of extensions in the range of about 25% to about 50%, about 27.5% to about 47.5%, about 30% to about 45%, or about 32.5% to about 42.5% of the total extensions have a profile ratio of greater than about 2:1.

In embodiments, an amount of extensions in the range of about 22.5% to about 47.5%, about 25% to about 45%, about 27.5% to about 42.5%, or about 30% to about 40% of the total extensions have a profile ratio of greater than about 2.4:1.

In embodiments, an amount of extensions in the range of about 30% to about 70%, about 35% to about 65%, about 40% to about 60%, or about 45% to about 55% of the total extensions have a profile ratio of less than about 1:1.

In embodiments, an amount of extensions in the range of about 5% to about 25%, about 7.5% to about 22.5%, about 10% to about 20%, or about 12.5% to about 17.5% of the total extensions have a profile ratio of less than about 1:4.

Figure 6:
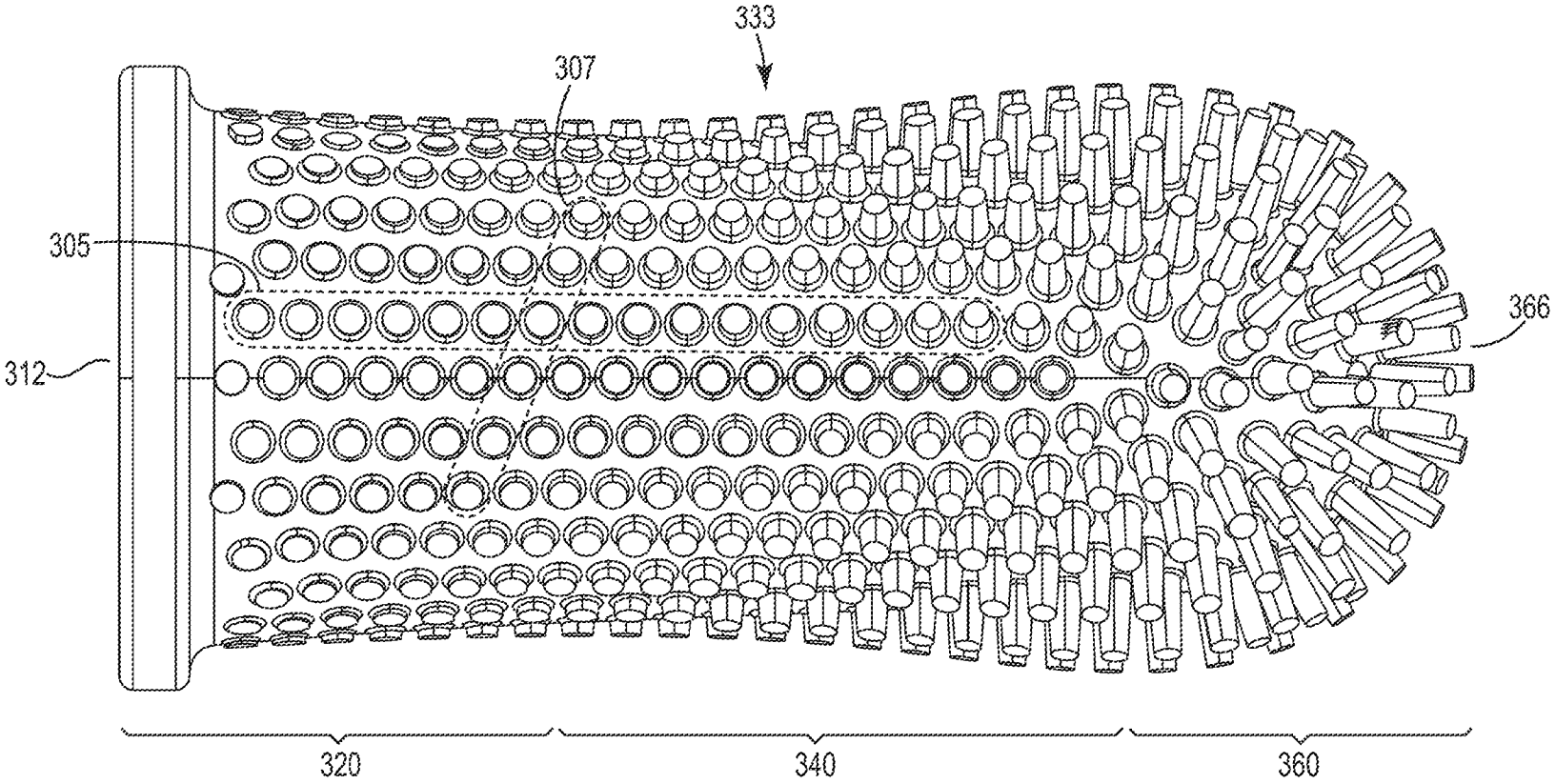
FIG. 6 is a perspective view of an embodiment of a finger-wearable oral hygiene device showing patterns of extensions on the surface.

In embodiments, the device can be described with regards to the pattern of extensions on the body member. For example, as shown in FIG. 6, the device comprises a plurality of columns of extensions (one representative column of extensions is encompassed within area 305 defined by the dashed line). Each column of extensions follows a linear path in a proximal to distal direction for a portion of the length of the device, with the columns being parallel to the central axis (CA) of the device. In embodiments of the disclosure, the linear path extends from the proximal end 312 to a point between the midpoint 333 and the distal end 366 along the device length. In embodiments of the disclosure, the linear path extends from the proximal end 312 to a point near or at the junction of the central 340 and distal 360 sections. For some columns of extensions, the linear path can deviate to a curved path toward the distal end 366 of the device, such as in the central section 340 and/or the distal section 360.

In aspects of the pattern of extensions, extensions in adjacent columns can be staggered in relation to each other. That is, in embodiments the extension may not align along a circumferential line (i.e., that is perpendicular to the central axis (CA)) on the body member. However, the staggered arrangement can provide the extensions in a defined pathway, such as shown by the series of extensions encompassed within area 307 defined by the dashed line. This pathway can be at an angle skew to the central axis (CA) or the plane perpendicular to the CA. This pathway can be part or all of an elliptical pathway around the surface of the body member. In an elliptical pathway, the path of the extension on one half of the device can be a mirror image of the path of the extensions on the other half of the device. Just as it can be seen that there are multiple parallel columns of extensions (e.g.) as represented by extensions in area 305, it can also be seen there are multiple elliptical pathways of extension around the surface of the body member, the elliptical pathways parallel to one another.

The device can be manufactured by conventional processes, such as molding, extruding, casting, shaping, cutting, or combinations of these processes. Elastomeric materials, such as those described herein, can be used. In some modes of manufacturing, the device is formed as halves, and then one half of the device heat formed or glued to the other half of the device. Using such an approach, a device with an extension pattern having a pathway that is part or all of an elliptical pathway as described herein can be formed.

The invention also provides methods for providing oral hygiene to a subject. In some methods, the oral hygiene can be cleaning the teeth of subject, stimulating the gums of a subject, or both. In some cases, the device of the disclosure can be used to clean an artificial article used in the oral cavity, such as dentures. An artificial article such as dentures can either be cleaned when the article is inside the oral cavity, or outside of the oral cavity.

In the method the oral hygiene device can be placed on a finger 515 (e.g., the index finger) such as shown in FIG. 8. In embodiments, and with reference to FIG. 9, the method includes steps of introducing the oral hygiene device 501 of the disclosure into the oral cavity 511 of a subject 503 and contacting gums or teeth of the subject with at least a portion of the extensions. Generally, the distal section (not shown), or the distal and at least part of the central section, is used to contact the teeth and/or gums. Since the distal section of the device has extensions of greater height these are particularly useful for cleaning teeth and/or stimulating gums.

Further, the improved design of the device in which the extensions are mostly or fully around the circumference of the body member facilitates efficient and more thorough oral hygiene. In particular, the step of contacting gums or teeth of the subject can include contacting with extension on one side of the device, and then contacting gums or teeth, such as gums or teeth in a different part of the oral cavity, with extensions on the other side of the device. For example, the device on a user's finger can be inserted into a subject's mouth and extensions on one side of the device (such as those corresponding to the location of the finger tip's skin, opposite the fingernail) are used to clean or massage lingual teeth or gums on the left side of the mouth, and then the finger is moved to the right side of the mouth and the lingual teeth or gums are contacted with extensions on the other side of the device (such as those corresponding to the location of fingernail). Gums or teeth on the facial (buccal) side can be massaged or cleaned more efficiently with the device of the disclosure as well.

Also, the extension profile of the device can provide greater comfort to a subject during an oral hygiene process. In particular, since the extensions in the proximal section of the device are generally shorter than those in the central or distal sections, longer extensions are largely not in contact with the lips of a subject during cleaning or massaging, and this in turn can be less irritating to the lips of a subject. For example, see FIG. 9, wherein the extensions that are shorter and in the proximal section 520 are more likely to be in contact with the lips of a subject, rather than the longer extensions near the distal end.

The invention also provides kits for providing oral hygiene to a subject. The kit can include device of the disclosure and an oral treatment composition, such as toothpaste or a composition that includes a medicament to treat gums, such as lidocaine, xylocaine, chlorhexidine, hyaluronic acid, corticosteroids, etc.

What is claimed is:

1. A finger-wearable oral hygiene device comprising:

a proximal section, a central section, a distal section, and a central axis;

a body member having proximal and distal ends, a body member length between the proximal and distal ends, and a circumference;

wherein the proximal end has an opening for insertion of a finger, and the distal end is closed and has a curved or rounded shape, and the device is designed to cover the distal phalange of a finger, at least a portion of the medial phalange, and a portion of the proximal phalange;

a wall defining the body member providing outer and inner surfaces;

a plurality of extensions extending from the outer surface of the body member, the plurality of extensions comprising an extension pattern defined by a plurality of columns of extensions, each column following a linear path that extends in a proximal to distal direction parallel to the central axis and a portion of the length of the device, and an overall device length as defined by the distance from a tip of the extensions at the distal end of the device, and the proximal end, wherein, as measured along the central axis, the proximal section extends a length in the range of 30-40% of the overall device length, the central section extends a length in the range of 40-54% of the overall device length, and the distal section extends a length in the range of 15-25% of the overall device length.

2. The device of claim 1 wherein the plurality of columns of extensions extends a full length of at least of the central section.

3. The device of claim 1 wherein the wall defining the body member providing outer and inner surfaces in the central section, when viewed as a cross section of the device in a plane intersecting the central axis, is linear.

4. The device of claim 1, wherein the wall of the body member has: (a) a thickness is the range of about 0.60 mm to about 0.90 mm, or in the range of about 0.70 mm to about 0.76 mm, wherein the device is configured so the inner surface of the wall of the body member is in direct contact with a user's finger, or (b) a thickness that is the same over the entire body member.

5. The device of claim 1, wherein: (a) the body member length is at least about 40 mm, in the range of about 40 mm to about 60 mm, or in the range of about 45 mm to about 55 mm, or (b) the overall device length of the device is about 5-12.5% longer than the body member length.

6. The device of claim 1 comprising a rim at the proximal end of the body member, the rim comprising an outer facing surface that when viewed as a cross section of the device in a plane intersecting the central axis, the outer facing surface is linear along most of its length.

7. The device of claim 1, wherein the extensions: (a) have lengths in the range of about 0.1 mm to about 3.5 mm, about 0.125 mm to about 3.25 mm, or about 0.15 mm to about 3.0 mm, or (b) extend around more than 95% of the circumference.

8. The device of claim 1, wherein the extensions have a circular shape at bases and tips of the extensions.

9. The device of claim 1, (a) having about 400 or greater, or about 500 or greater extensions, or (b) wherein the body member has an outer surface area of at least about 2000 $mm^2$.

10. A method for providing oral hygiene to a subject, comprising introducing the device of claim 1 into the oral cavity of a subject and contacting gums or teeth of the subject with at least a portion of the extensions, wherein the subject is a child or a pet.

11. A kit for providing oral hygiene to a subject, comprising the device of claim 1 and an oral treatment composition.

12. A finger-wearable oral hygiene device comprising:

a body member having proximal and distal ends, a body member length between the proximal and distal ends, a circumference, and a central axis;

an overall device length as defined as the distance from a tip of the extensions at the distal end of the device to the proximal end, as measured along the central axis;

wherein the proximal end has an opening for insertion of a finger and, around the circumference at the proximal end, a proximal end outer surface portion without extensions, and the distal end is closed and has a curved or rounded shape, and the device is designed to cover the distal phalange of a finger, at least a portion of the medial phalange, and a portion of the proximal phalange;

a wall defining the body member providing outer and inner surfaces;

a plurality of extensions extending from at least a portion of the outer surface of the body member, wherein the outer surface portion having the plurality of extensions is defined as starting from the distal end and is at least about 55% of the overall device length, wherein the plurality of extensions comprises an extension pattern defined by a plurality of columns of extensions, wherein the columns follow a linear path that extends in a proximal to distal direction parallel to the central axis, the linear path extending at least most of the outer surface portion that is at least about 55% of the overall device length, where, in the plurality of columns of extensions, there are shorter extensions adjacent to the proximal end outer surface portion, and longer extensions adjacent to the distal end.

13. The device of claim 12 wherein the outer surface portion having the plurality of extensions is at least about 60% of the overall device length, and the linear path extends at least most of the outer surface portion that is about 60% of the overall device length.

14. The device of claim 12 having a central portion, wherein the plurality of columns of extensions extends a full length of at least of the central portion of the device, wherein the central portion extends a length in the range of 40-54% of the overall device length.

15. The device of claim 12, wherein the plurality of columns of extensions, the extensions increase in length towards the distal end.

16. The device of claim 12, wherein the extensions extend around more than 95% of the circumference.

17. The device of claim 12, wherein the extensions have a circular shape at bases and tips of the extensions.

18. The device of claim 12, wherein the extensions have lengths in the range of about 0.1 mm to about 3.5 mm, about 0.125 mm to about 3.25 mm, or about 0.15 mm to about 3.0 mm.

19. The device of claim 12 wherein the proximal end outer surface portion without extensions comprises a rim.

20. A finger-wearable oral hygiene device comprising:

a body member having proximal and distal ends, a body member length between the proximal and distal ends, a circumference, and a central axis;

an overall device length as defined as the distance from a tip of the extensions at the distal end of the device to the proximal end, as measured along the central axis;

wherein the proximal end has an opening for insertion of a finger, and the distal end is closed and has a curved or rounded shape, and the device is designed to cover the distal phalange of a finger, at least a portion of the medial phalange, and a portion of the proximal phalange;

a wall defining the body member providing outer and inner surfaces;

a plurality of extensions extending from at least a portion of the outer surface of the body member, wherein the outer surface portion having the plurality of extensions is defined as starting from the distal end and is at least about 55% of the overall device length, wherein the plurality of extensions comprises an extension pattern defined by a plurality of columns of extensions, wherein the columns follow a linear path that extends in a proximal to distal direction parallel to the central axis, the linear path extending at least most of the outer surface portion that is at least about 55% of the overall device length, where, in the plurality of columns of extensions, there are shorter extensions adjacent to the proximal end and longer extensions adjacent to the distal end.

* * * * *